US006499541B1

(12) United States Patent
Hiron et al.

(10) Patent No.: US 6,499,541 B1
(45) Date of Patent: Dec. 31, 2002

(54) METHOD OF INSTALLING COMPONENTS IN A DOWNHOLE APPARATUS, AND APPARATUS OBTAINED THEREBY

(75) Inventors: Stephane Hiron, Igny (FR); Christophe Rayssiguier, Houston, TX (US); Vincent Tourillon, Paris; Gilles Cantin, Verrieres-le-Buisson, both of (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/582,949

(22) PCT Filed: Nov. 9, 1999

(86) PCT No.: PCT/EP99/08697

§ 371 (c)(1),
(2), (4) Date: Jul. 7, 2000

(87) PCT Pub. No.: WO00/29718

PCT Pub. Date: May 25, 2000

(30) Foreign Application Priority Data

Nov. 17, 1998 (FR) ..... 98 14405

(51) Int. Cl.[7] ..... E21B 23/00

(52) U.S. Cl. ..... 166/381; 166/66; 166/162

(58) Field of Search ..... 166/65.1, 66, 378, 166/380, 381, 115, 162

(56) References Cited

U.S. PATENT DOCUMENTS

| | | | | | |
|---|---|---|---|---|---|
| 4,284,142 | A | * | 8/1981 | Kirkland | 166/344 |
| 4,690,212 | A | * | 9/1987 | Termohlen | 166/65.1 |
| 4,799,544 | A | * | 1/1989 | Curlett | 166/65.1 |
| 5,303,773 | A | * | 4/1994 | Czernichow et al. | 166/66 |
| 6,135,209 | A | * | 10/2000 | Uhlenkott | 166/369 |

* cited by examiner

*Primary Examiner*—David Bagnell
*Assistant Examiner*—Jennifer R. Dougherty
(74) *Attorney, Agent, or Firm*—Brigitte L. Jeffery

(57) ABSTRACT

In downhole apparatus for an oil well, components (26) are installed in tubes (28) received in a space defined between an outer case (20) and an inner length of cylindrical production column (24) that is eccentric relative to the case (20). Each tube (28) is fixed at one end to an interconnection box (30) that is also received in said space, and that has electrical conductors passing therethrough. The tubes (28) are fixed to the box (30) by welding, and the ends of the tubes remote from the box are closed by plugs that are welded on.

38 Claims, 2 Drawing Sheets

METHOD OF INSTALLING COMPONENTS IN A DOWNHOLE APPARATUS, AND APPARATUS OBTAINED THEREBY

TECHNICAL FIELD

The invention relates to a method of installing components in a space defined between a cylindrical outer case of apparatus placed down an oil or gas well and a cylindrical inner passage passing through the apparatus.

Throughout this text, the term "component" designates any type of electrical or electronic circuit be it simple or complex, integrated or otherwise, isolated or associated with other items, and also other components such as sensors, motors, etc. . . . .

The invention also relates to a downhole apparatus including components installed by the method.

STATE OF THE ART

In apparatuses that are to stay permanently down a well that is in production, an ever-increasing number of electrical devices such as motors, sensors, actuators, etc. are being used. A consequence of that is to increase the size of the components that need to be installed in such apparatuses.

In the past, when the components were small in size, they could be installed without difficulty in small boxes fixed along the production column defining the cylindrical inner passage of which the hydrocarbon rises. Such an arrangement has been in use for many years, in particular for installing pressure sensors on apparatuses that are designed to remain permanently downhole or on test apparatuses associated with drilling strings.

Because of the ever increasing complexity of components, that type of installation is generally no longer usable since it is unsuited to the largest sizes of such components.

A first conventional solution for solving this new requirement is shown diagrammatically in cross-section in FIG. 1 of the accompanying drawings.

In that case, the components 1 are installed in an annular space 2 formed between a tubular outer case 3 and a tubular inner production column 4 defining internally a cylindrical inside passage 5 up which hydrocarbon rises. In that arrangement, used in particular for test apparatuses installed on drilling strings, the outer case 3 and the production column 4 are arranged coaxially.

The conventional arrangement shown in FIG. 1 is generally satisfactory. Nevertheless, it can only be used when the ratio between the diameter of the outer case 3 and the diameter of the inner production column 4 is sufficiently large to define an annular space 2 between them that is capable of housing all of the components 1 that are to be installed in the apparatus under consideration.

When the above-mentioned diameter ratio becomes too small, it is conventional to use a second installation technique which is shown diagrammatically in cross-section in FIG. 2 of the accompanying drawings.

In that arrangement, the small ratio of the diameters between the tubular outer case of the device and the cylindrical inner passage 5 is compensated by locating the passage eccentrically. In general, the components 1 are then installed in recesses 6 machined externally in a solid metal core 7. Once the components 1 have been mounted in the recesses 6, the recesses are closed in sealed manner by covers 8 which are either welded at 9 to the core 7, or else are closed by a tubular sheath surrounding the core.

That conventional arrangement suffers from numerous drawbacks.

Thus, because of the large radius of curvature of the outer case of the apparatus, the covers 8 or the sheath need to be very thick in order to be capable of withstanding the large pressure difference that exists between the external downhole pressure (frequently 1000 bars to 1500 bars) and the internal atmospheric pressure. The large thickness of the covers or of the sheath significantly reduces the amount of space available for the components, and that goes against the desired objective.

Given the sometimes very large dimensions of the recesses 6, and in order to avoid excessively increasing the thickness of the covers 8 or of the sheath, use is sometimes made of support props 10 interposed between the cover 8 or the sheath and the bottom of a recess 6. In order to be effective, such support props must be of large section and they must be relatively close together, thereby likewise reducing the space available for components and requiring modifications to their shapes and above all to their interconnections when they are electronic components. In addition, the presence of support props 10 does not prevent the covers 8 or the sheath from sagging under the effect of the pressure difference in those portions of the covers that are not provided with support props.

When covers are used to close the recesses, another major problem that arises with the conventional arrangement as shown in FIG. 2 lies in obtaining leakproof sealing between the covers 8 and the core 7, since the sealing must be capable of withstanding the large difference between the external pressure downhole and the atmospheric pressure that exists inside the recesses 6.

Thus, achieving such sealing by means of elastomer gaskets is not recommended for use of long duration because such gaskets age. Furthermore, metal-on-metal sealing is difficult to design.

The only technique that can guarantee the desired degree of sealing in the long term is therefore welding. Because of the shapes of the covers, TIG welding is generally preferred over electron beam welding. Nevertheless, that type of welding suffers from the drawback of heating the components and, with some materials, of giving rise to stresses in the steel used for making the core 7 and the covers 8 or the sheath. These stresses can be relaxed only by subsequent heat treatment that certain components are incapable of withstanding. Such an operation is therefore not performed. As a result there is a significant increase in the risk of the core corroding.

Furthermore, for reasons of reliability, some components such as electronic circuits must be maintained as far as possible in an environment that is clean, in particular during manufacture and assembly. When the arrangement shown in FIG. 2 is used, it is very difficult to satisfy this condition during the step of mounting the circuits. Welding the covers 8 onto the core 7 by means of the TIG technique is an operation that is lengthy, and that takes place in a workshop in an environment that is ill-suited to protecting components.

The way in which the covers 8 are fixed onto the core 7 also makes repairing or replacing the components completely impossible. If a component fails, the core must necessarily be returned to the workshop to be cut up.

Other drawbacks of the technique shown in FIG. 2 stem in particular from using a core 7 that is in a single piece. That characteristic gives rise to high raw materials and machining costs and to machining operations that are complex and that require, for example, a certain number of bores to be made such as the bore referenced 11 to enable electrical link conductors to pass between components installed in different recesses 6. The complexity of the machining applied to the core gives rise to a non-negligible risk of it being necessary to remake the piece completely in the event of an error occurring during machining.

Furthermore, the presence of large internal volumes under atmospheric pressure inside the recesses 6 makes it necessary to use high quality alloys so as to withstand the pressure difference. Such alloys are more difficult to machine and above all they are more expensive than traditional alloys.

Finally, because the components 1 are mounted directly on the core 7 which withstands the mechanical forces applied to the production column (tension/compression, twisting, thermal expansion), it is necessary to decouple the components mechanically from the core.

SUMMARY OF THE INVENTION

A particular object of the invention is to provide a method enabling components to be installed in an original manner in downhole apparatus, particularly when the ratio of inside to outside diameters is too small to allow annular installation of the type described above with reference to FIG. 1.

More precisely, the invention provides a method of installing components in a space defined between an outer cylindrical case of downhole apparatus and a cylindrical passage passing through the apparatus in its longitudinal direction, the method being characterized in that it consists in mounting said components in a plurality of sealed tubes disposed in said space, one end of each tube being fixed to an interconnection box that is also placed in said space.

The installation method defined in this way solves all of the problems posed by the conventional techniques described above with reference to FIGS. 1 and 2.

Thus, by mounting the components in tubes of relatively small diameter it is possible to use walls of small thickness, thereby releasing a maximum amount of volume for the components. In addition, the preferably cylindrical shape of these tubes makes it possible to weld them at respective first ends to the interconnection box and to close them at their opposite ends by means of welded plugs. Reliable and effective sealing is thus obtained without any risk of damaging the components.

Furthermore, it is easy to preserve a clean environment for the components during assembly. Once they have been inserted into the tubes, which can be done in a clean room provided for this purpose, the tubes can be closed immediately in sealed manner by screwing the plugs into place with interposed sealing gaskets. The plugs can subsequently be welded in a workshop designed for that purpose without the clean environment of the components being affected.

The installation method of the invention also makes it possible to interconnect the components by means of electrical conductors which pass through the inter-connection box. Complex machining and sealing is thus avoided.

Mounting the components in tubes also makes it possible to eliminate any solid pieces and the lengthy and complex machining that would be associated therewith. This makes it possible to dissociate the electrical portions completely from the mechanical portions. In addition, this form of assembly reduces raw materials costs and machining costs and makes it possible to perform maintenance or component replacement operations, should that be necessary. Advantageously, the method of the invention is applied to the situation where the cylindrical passage is eccentric relative to the outer case of the apparatus.

The invention also provides downhole apparatus comprising a cylindrical outer case with a cylindrical passage passing therethrough in a longitudinal direction, and components mounted in a space defined between the case and the passage, the apparatus being characterized in that it further comprises a plurality of sealed tubes disposed in said space and in which the components are housed, and an interconnection box also disposed in said space and to which one end of each tube is fixed.

Preferably, the tubes extend in said longitudinal direction and they are advantageously fixed to the inter-connection box by circular welds.

Similarly, each plug is preferably fixed to one of the tubes by a circular weld and is advantageously fitted in an open end of the tube with an interposed sealing gasket.

BRIEF DESCRIPTION OF THE DRAWINGS

A preferred embodiment of the invention is described below by way of non-limiting example and with reference to the accompanying drawings, in which.

DETAILED DESCRIPTION OF A PREFERRED EMBODIMENT OF THE INVENTION

Figure 3:
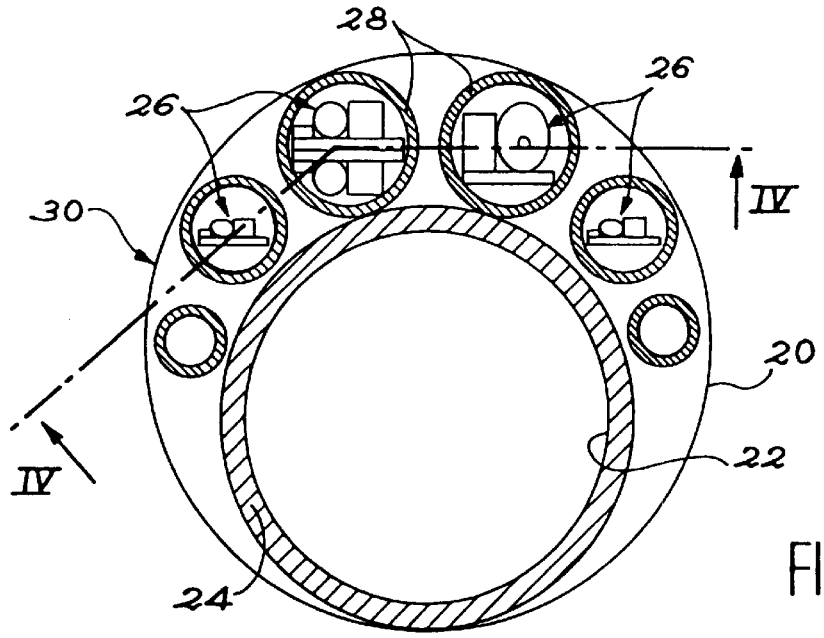
FIG. 3 is a cross-section through downhole apparatus showing how components are installed in accordance with the invention.
Figure 4:
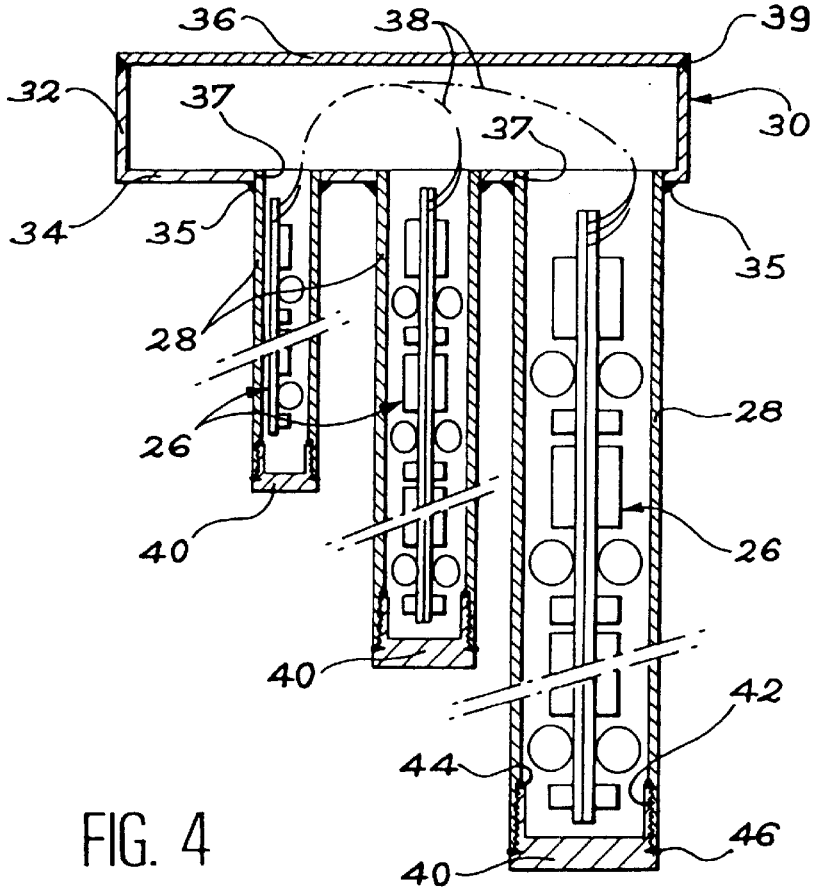
FIG. 4 is a section view on line IV—IV of FIG. 3.

FIGS. 3 and 4 are diagrams showing a portion of downhole apparatus in accordance with the invention. Such apparatus is generally intended to remain permanently down an oil or gas well. Nevertheless, the apparatus may equally well be designed to be inserted temporarily downhole, in particular for the purpose of performing various measurements therein.

Downhole apparatus traditionally comprises various modules placed end to end. Only the electronics module of the apparatus is shown in FIGS. 3 and 4. The other modules may be implemented in any manner and there may be any number of them, without going beyond the ambit of the invention.

Figure 1:
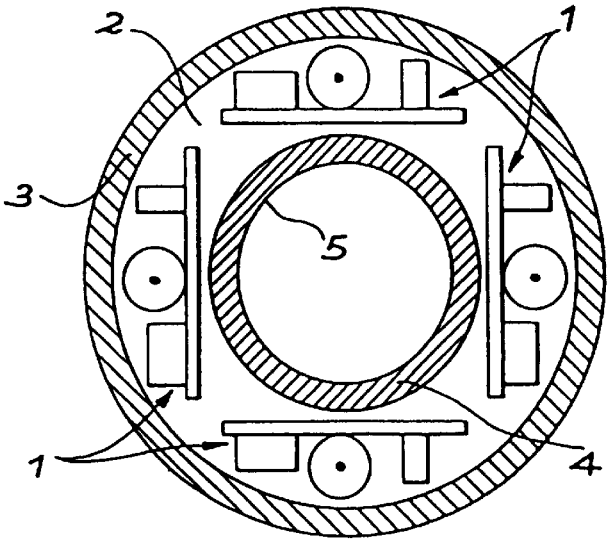
FIG. 1 PRIOR ART
FIG. 1, described above, is a cross-section showing a first prior art technique for installing components in downhole apparatus.

The invention applies particularly, but not exclusively, to the case where the diameter ratio between the cylindrical outer case 20 and the cylindrical inner passage 22 is too small to enable components that may be large size to be installed using a traditional coaxial arrangement as described above with reference to FIG. 1.

Figure 2:
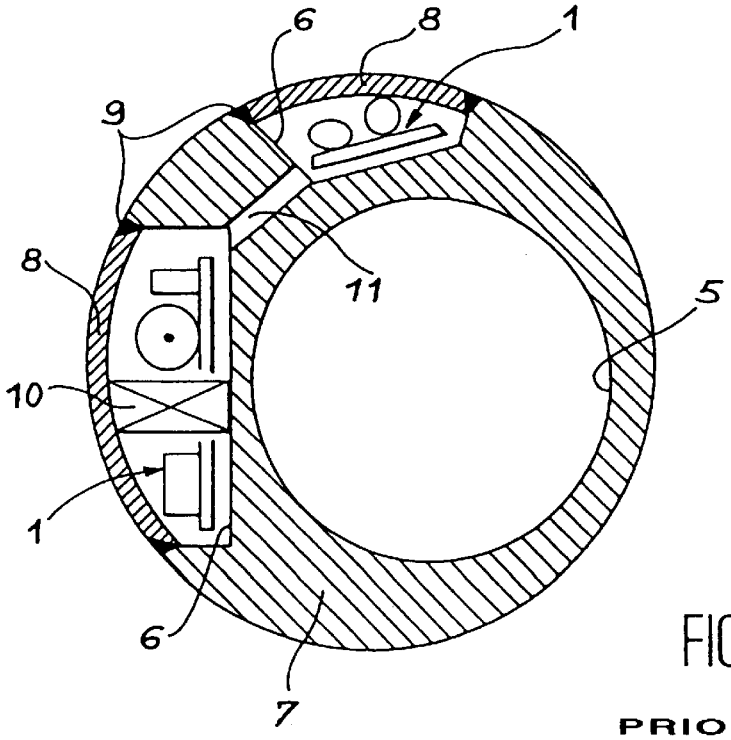
FIG. 2 PRIOR ART
FIG. 2, described above, is a cross-section showing a second prior art technique for installing components in downhole apparatus.

Consequently, in the electronics module of the apparatus, an arrangement is adopted in which the cylindrical passage 22 is eccentric relative to the cylindrical outer case 20, as in the conventional technique described above with reference to FIG. 2. Nevertheless, under such circumstances, the inner cylindrical passage 22 along which the petroleum fluid flows is made directly out of a length of production column 24 of uniform thickness, and not out of a solid piece that needs to be subjected to complex machining.

In the space defined between the length of production column 24 and the outer case 20, the components 26 are received in sealed tubes 28 extending in the longitudinal direction of the cylindrical passage 2 and of the outer case 20. As can be seen in particular in FIG. 3, the tubes 28 are circular in cross-section and they are dimensioned so as to extend to the immediate vicinity of the length of production column 24 and of the outer case 20 so as to have a diameter that is as large as possible.

When the apparatus is downhole, the walls of the tubes 28 are subjected to the high pressure difference that exists between the downhole pressure (e.g. 1000 bars to 1500 bars) and the atmospheric pressure that exists inside the tubes. Nevertheless, because of the relatively small diameters of the tubes, satisfactory mechanical strength can be obtained by giving each tube 28 walls of relatively small thickness. This leads to maximizing the inside diameter of each of the tubes 28, thereby enabling the tubes to receive components 26 of relatively large dimensions.

As shown in FIG. 4, the tubes 28 can be of various lengths, depending on the dimensions of the components 28 that they are to receive.

At an open first end that is upwardly directed in FIG. 4, each of the tubes 28 is fixed to a radial wall 34 of an interconnection box 30 that is likewise leakproof. This interconnection box 30 is approximately crescent shaped when observed on the axis of the well. It is defined in the radial direction between the outside surface of the length of production column 24 and a cylindrical wall 32 whose outside surface coincides with the outer case 20. In the axial direction, the inter-connection box 30 is defined between two radial walls 34 and 36 that are plane and parallel.

The radial wall 34 on which the tubes 28 are fixed has a circular opening 37 for each of the tubes. Each circular opening 37 has the same diameter as the outside diameter of the corresponding tube 28. Thus, the open end of each of the tubes 28 that is fixed to the inter-connection box 30 penetrates into a corresponding opening 37. The tubes are fixed to the wall 38, preferably by welding, before the components 26 are put into place. In FIG. 4, references 35 designates the circular welds obtained in this way.

The end of each of the tubes 28 that is fixed to the wall 34 of the interconnection box 30 is open so as to enable electrical conductors 38 to pass through and electrically connect the components 26 by passing through the inter-connection box 30, as represented by chain-dotted lines in FIG. 4.

At its end remote from the interconnection box 30, each of the tubes 28 is closed in sealed manner by a respective plug 40. More precisely, the end of each tube 28 that is remote from the interconnection box 30, i.e. that faces downwards in FIG. 4, is initially open and includes tapping 42. When the components 26 are mounted in the tubes 28, preferably in a clean room, the tubes are closed immediately thereafter in sealed manner by screwing the plugs 40 into the tapping 42. When this takes place, sealing is provided in temporary manner by a sealing gasket 44, e.g. of the elastomer O-ring type, which is interposed between each of the tubes 28 and its plug 40.

Long-term sealing is obtained by fixing each plug 40 to the end of the corresponding tube 28 by a weld 46 that is preferably made using the electron beam technique. This technique can be implemented because the weld 46 is circular in shape.

It should be observed that, because of the sealing that is provided immediately by the elastomer O-rings 44, the welds 46 can easily be made in an appropriate workshop without spoiling the clean atmosphere in which the components 26 are located.

The electrical conductors 38 interconnecting the various components 26 by passing through the inter-connection box 30 are put into place when the components are themselves inserted in the tubes 28. This can be done by giving the electrical conductors 38 significant extra length so that welding can be performed when one of the circuits is still outside the tube that is to receive it. In a variant, the electrical conductors 38 can also be put into place prior to the radial wall 36 of the box 30 that is remote from the tubes 28 (FIG. 4) being fixed in place by welding 39.

Various additional arrangements can be adopted without going beyond the ambit of the invention.

Thus, the components 26 are advantageously mounted in the tubes 28 via interposed damper and retaining members (not shown) which can be of any configuration.

In addition, members (not shown) can be provided for holding the tubes 28 against the length of production column 24 at a distance from the interconnection box.

Furthermore, one or more covers (not shown) can be placed around the tubes 28 along the outer case 20 to protect the tubes mechanically during handling.

The above-described technique of installing components 26 makes it possible to dissociate the components completely from mechanical parts. Furthermore, the proposed arrangement makes it possible to use electron beam welding to close the tubes in which the components are housed and to fix them to the inter-connection box. Also, the length of tube 24 can be made out of standard alloy, thereby enabling its cost to be reduced very significantly. On the same lines, manufacturing tolerances for the length of production column 24 are much slacker than they are in the known technique as described above with reference to FIG. 2. This also contributes to reducing overall cost.

The total mass of the apparatus is also significantly smaller than that of the prior solution described above with reference to FIG. 2. The tubes 28 in which the components are housed can be made of an appropriate special steel so as to protect the components, but of reduced thickness because of the relatively small diameters of the tubes. Since the tubes are not subjected to the mechanical forces that are applied to the apparatus, there is no risk of these forces being transmitted to the components.

The arrangement of the invention also makes it possible to perform component repair and replacement operations without special difficulty. Such operations are performed by cutting off the closed end of the corresponding tube that is remote from the inter-connection box, taking the appropriate action, and then putting a new plug into place in the same manner as that described above. This ease with which action can be taken is associated with the modular nature of the arrangement which makes it possible to envisage a wide variety of ways in which the components can be installed by acting both on the diameters and the lengths of the tubes in which they are housed.

Finally, as already mentioned, the installation method of the invention is entirely compatible with rules of the art in the electronics industry that require circuits to be kept permanently under conditions of good cleanliness. Also, any type of cabling including complex cabling can be considered without special difficulty since the electrical conductors 38 pass through the interconnection box 30 at atmospheric pressure without passing through any partitions.

What is claimed is:

1. A method of installing components (26) in a space defined between an outer cylindrical case (20) of downhole apparatus and a cylindrical passage (22) passing through the apparatus in its longitudinal direction, the method being characterized in that it consists in mounting said components (26) in a plurality or scaled tubes (28) disposed in said space, one end of each tube (28) being fixed to an interconnection box (30) that is also placed in said space, the components (26) being inserted via an open end of each tube (28) remote from the interconnection box (30), and in which said open end is closed in scaled manner by means of a plug (40).

2. The method according to claim 1, in which the components (26) are mounted in a plurality of cylindrical scaled tubes (28).

3. The method according to claim 1, in which the tubes (28) are disposed in said longitudinal direction.

4. The method according to claim 1, in which the components (26) are interconnected by electrical conductors (38) that pass through the interconnection box (30).

5. The method according to claim 1, in which each sealed tube (28) is fixed to the interconnection box (30) by welding.

6. The method according to claim 1, in which immediately after the components (26) have been mounted in the tubes (28), the tubes (28) are closed in sealed manner by screwing the plugs (40) into the open ends of the tubes with interposed sealing gaskets (42).

7. A method according to claim 6, in which the plugs (40) are subsequently fixed to the tubes (28) by welding.

8. The method according to claim 1, in which the cylindrical passage (22) is eccentric relative to said case (20).

9. A downhole apparatus comprising a cylindrical outer case (20) with a cylindrical passage (22) passing therethrough in a longitudinal direction, and components (26) mounted in a space defined between the case and the passage, the apparatus being characterized in that it further comprises a plurality of sealed tubes (28) disposed in said space and in which the components (26) are housed, and an interconnection box (30) also disposed in said space and to which one end of each tube (28) is fixed, the passage being eccentric relative to the outer case.

10. Apparatus according to claim 9, in which the tubes (28) are cylindrical.

11. Apparatus according to claim 9, in which the tubes (28) extend in said longitudinal direction.

12. Apparatus according to any one of claim 9, in which electrical conductors (38) interconnecting the components (26) pass through the interconnection box (30).

13. The apparatus according to claim 9 wherein each tube has an open end.

14. The apparatus according to claim 13 wherein said open end is closed by a plug.

15. The apparatus of claim 14 wherein said plug screwed into the open end.

16. The apparatus of claim 14 wherein said plug welded to said open end.

17. The apparatus of claim 14 further including a sealing gasket interposed between each tube and the plug.

18. A method of installing components in a space defined between an outer case of downhole apparatus and a passage passing through the apparatus, the method comprising the steps of:

mounting said components in a plurality of sealed tubes disposed in said space by inserting said components via an open end of each tube; and fixing one end of each tube to an interconnection box.

19. The method of claim 18 further including interconnecting said components.

20. The method of claim 18 further including closing said open end.

21. The method of claim 20 wherein closing being performed in scaled manner.

22. The method of claim 20 wherein closing being performed by way of a plug.

23. The method of claim 22 wherein closing including interposing scaling gaskets between each tube and the plug.

24. The method of claim 22 wherein closing including screwing the plug into the open end.

25. The method according to claim 22, wherein the plug fixed to the tube by welding.

26. The method of claim 25 wherein welding performed by way of an electron beam technique.

27. Downhole apparatus comprising an outer case with a passage and components mounted in a space defined between the case and the passage, the passage being eccentric relative to the outer case, the apparatus being characterized in that it further comprises a plurality of sealed tubes disposed in said space and in which the components are housed, and an interconnection also disposed in said space and to which one end of each tube is fixed.

28. The apparatus of claim 27 wherein said passage extends in a longitudinal direction of said apparatus.

29. The apparatus according to claim 27 wherein the tubes extend in a longitudinal direction of said apparatus.

30. The apparatus of claim 27 wherein said passage is cylindrical.

31. The apparatus of claim 27 wherein the tubes are cylindrical.

32. The apparatus according to claim 27 wherein said components are coupled by way of electrical conductors.

33. The apparatus of claim 32 wherein said electrical conductors are coupled to said interconnection.

34. The apparatus of claim 27 wherein each tube has an open end.

35. The apparatus of claim 34 wherein said open end is closed by a plug.

36. The apparatus of claim 35 wherein said plug screwed into the open end.

37. The apparatus of claim 36 wherein said plug is welded to said open end.

38. The apparatus of claim 35 further including a scaling gasket interposed between each tube and the plug.

* * * * *